United States Patent [19]

Gingerich et al.

[11] 4,329,169

[45] May 11, 1982

[54] METHOD FOR PRODUCING COBALT METAL POWDER

[75] Inventors: Richard G. W. Gingerich; Richard A. Scheithauer, both of Towanda, Pa.

[73] Assignee: GTE Products Corporation, Stamford, Conn.

[21] Appl. No.: 179,332

[22] Filed: Aug. 18, 1980

[51] Int. Cl.[3] ..... B22F 9/00

[52] U.S. Cl. ..... 75/0.5 AA; 75/119; 423/141; 423/144

[58] Field of Search ..... 75/0.5 R, 0.5 A, 0.5 AA, 75/0.5 B, 0.5 BA, 103, 119; 423/140, 141, 143, 144, 145, 413

[56] References Cited

U.S. PATENT DOCUMENTS

| | | | |
|---|---|---|---|
| 2,728,636 | 12/1955 | Von Hare, Jr. et al. | 423/413 |
| 2,734,821 | 2/1956 | Schaufelberger | 75/119 |
| 3,967,958 | 7/1976 | Coffield et al. | 423/144 |
| 4,002,719 | 1/1977 | Tsao | 423/144 |
| 4,214,895 | 7/1980 | Gingerich et al. | 75/0.5 AA |
| 4,233,063 | 11/1980 | Ritsko et al. | 75/0.5 AA |

*Primary Examiner*—Michael L. Lewis

*Attorney, Agent, or Firm*—Robert E. Walter

[57] ABSTRACT

Fine particle size cobalt metal powder is prepared absent tailings by heating an aqueous solution of soluble cobaltic ammine halide to a temperature of at least about 120 degrees centigrade for a sufficient period of time to decompose said cobaltic ammine halide and form a cobalt containing precipitate. The precipitate is separated from the solution and reduced in a reducing atmosphere to produce fine metal cobalt powder.

7 Claims, No Drawings

METHOD FOR PRODUCING COBALT METAL POWDER

CROSS REFERENCE TO RELATED APPLICATIONS

Co-pending applications relating to the production of fine metal cobalt include Ser. No. 038,973, now U.S. Pat. No. 4,214,896, relating to mother liquor treatment, Ser. No. 038,968, now U.S. Pat. No. 4,214,894, utilizing an ion exchange resin during cobalt liquor processing, Ser. No. 038,972, now U.S. Pat. No. 4,233,063, including an ammonia recycling step, Ser. No. 038,970, now U.S. Pat. No. 4,218,240, relating to producing cobaltic hexammine complex as an intermediate step, and Ser. No. 038,971, now U.S. Pat. No. 4,214,895, relating to the use of a metallic hydroxide to form a cobalt containing precipitate.

TECHNICAL FIELD

This invention relates to the production of fine cobalt metal powder from an impure cobalt source, and more particularly relates to the process for obtaining such powder by the hydrogen reduction of a precipitate obtained from an aqueous solution containing cobalt.

Fine cobalt powder of high purity is typically used in the manufacture of cemented carbide cutting tools, magnetic tapes, and magnetic inks.

BACKGROUND OF THE INVENTION

According to German Pat. No. 2,319,703, it is known to separate cobalt from nickel by a process which includes forming pentammine sulfate complexes of the two ions in solution. However, it has been found that soluble cobalt ammine sulfates can only be reduced while still in solution, under pressure, and with the aid of catalysts. Furthermore, the resulting cobalt powder is not fine particle size.

U.S. Pat. No. 4,093,450 to Doyle et al. describes a process for producing fine particle size cobalt metal powder by the hydrogen reduction of cobalt oxide obtained from a cobalt pentammine carbonate solution. The precipitate was formed by heating the solution to drive off ammonia and carbon dioxide to form a precipitate of cobalt oxide. This process requires a solution of approximately four grams per liter of cobalt to produce a metal powder having a particle size less than one micron. Note that the final resulting particle size is less than one micron is highly dependent on the concentration of cobalt employed in the aqueous solution.

U.S. Pat. No. 4,184,868 to Ritsko et al relates to a process for producing metal powder cobalt by forming a cobalt pentammine chloride solution, digesting the solution to form a black precipitate, and reducing the precipitate to form cobalt metal powder.

The following patents are directed to the separation of cobalt from other cations, especially nickel. The resulting cobalt compounds are not disclosed as being sources for forming fine particle size cobalt.

U.S. Pat. No. 2,879,137 to Bare et al. discloses the treatment of an ammoniacal ammonium carbonate solution obtained from leaching an ore and containing nickel wherein the cobalt present in the cobaltic state is treated with an alkali metal or alkaline earth metal hydroxide under controlled temperature conditions to precipitate the nickel free of cobalt.

U.S. Pat. No. 3,928,530 to Bakker et al. discloses a process for the separation of nickel and cobalt by forming pentammine chloride complexes in solution containing a high concentration of ammonium chloride, and precipitating cobalt pentammine chloride.

In German Pat. No. 1,583,864, cobalt is recovered from scrap by digestion of the scrap in HCl and $MgCl_2$ solution, followed by removal of iron and chromium impurities by precipitation at a moderately acid pH followed by extracting a cobalt chloride complex with a long chain tertiary ammine in an aromatic solvent.

U.S. Pat. No. 4,108,640 to Wallace discloses a process for recovering metallic cobalt from an aqueous ammoniacal solution wherein the solution is contacted with a water immiscible liquid ion exchange reagent dissolved in an inert organic diluent to selectively extract the other metal from the solution and produce an organic extract loaded with the other metals and an aqueous cobalt bearing raffinate substantially free of the other metals.

SUMMARY OF THE INVENTION

A problem encountered in the production of cobalt according to the method described in U.S. Pat. No. 4,184,868 discussed above is the production of hard tailings after reduction. Such tailings are larger particles than the desired fine powder and must be reprocessed. It is an object of the present invention to reduce the amount of tailings formed and hence increase the yield of fine metallic cobalt particles.

It is another object of the present invention to provide a process which can be used to effectively form fine cobalt powder over a wide range of concentrations of cobalt in the initial solution.

Other and further objects of the present invention will become apparent from the following description.

In accordance with the present invention, there is provided a method for producing fine particles of cobalt metal powder comprising heating an aqueous solution of a soluble cobaltic ammine halide to a temperature of at least about 120 degrees centigrade for a sufficient period of time to decompose said cobaltic ammine halide and form a cobalt containing precipitate, separating the cobalt containing precipitate from the resulting solution, and reducing said cobalt containing precipitate to form fine particles of cobalt.

DETAILED DESCRIPTION

Fine particle size cobalt, typically having a Fisher Sub Sieve Size (FSSS) from about 0.5 to about 3.0, is produced directly by the reduction of a cobalt containing precipitate which is formed by heating an aqueous solution of a soluble cobaltic ammine halide. The cobalt containing precipitate may be formed from solutions having a wide range of cobaltic ammine halide concentration. Preferably the solution contains cobaltic ammine halide from about 5 grams per liter based on the weight of cobalt up to the limits of solubility of the cobaltic ammine halide. Cobaltic ammine halide is more preferably present in solution in an amount from about 5 grams to about 60 grams and more preferably from about 10 grams to about 50 grams based on the cobalt present in solution.

It is contemplated that the solution containing the soluble cobaltic ammine halide may be derived from a variety of sources. The purity of the resulting metallic cobalt is dependent on the purity of the starting solution in that certain metallic cations which may be regarded as impurities may precipitate with the cobalt and may be present in the final reduced cobalt metallic powder. The solution preferably consists essentially of aqueous cobaltic ammine halide and an acceptable amount of impurities.

It is generally preferred that the cation impurities be present in the solution in an amount less than about 2 percent by weight based on the amount of cobalt present in the solution. Typical cation impurities include iron, manganese, copper, aluminum, chromium, magnesium, calcium, etc. For the preparation of cobalt powders to be used in the cemented carbide industry, it is preferable that the cation impurity of the solution be less than about 0.2 percent by weight based on the cobalt present in solution.

Typical solutions containing cobalt which may be utilized in the present invention may be derived from sludges and leach solutions from cemented carbide or tungsten recovery operations. For those solutions containing the cobaltous ion, oxidation to the cobaltic ion is preferable to result in improved recovery.

According to one process, a cobalt source containing various impurities is digested in hydrochloric acid solution to obtain a solution of about 60 to 150 grams per liter of cobalt in a 1 to 6 molar hydrochloric acid solution. Ammonium hydroxide is added to result in a concentration of about 100 to 150 grams per liter of ammonium chloride at a pH of about 9.0 to 10.0. Air oxidation of the cobaltous ion to cobaltic results in the formation of cobaltic ammine ions. At least a portion of the cobaltic ammine ions are preferably present in the form of cobaltic hexammine and halocobaltic pentammine having the formula $Co(NH_3)_6+++$ and $Co(NH_3)_5X++$ wherein X is a halogen or hydroxide.

It is preferable to reduce the cation impurities by further purification of the solution. According to one such method, a solution which has been formed by the digestion of the cobalt source in hydrochloric acid according to the above method and containing cobalt ammine ions may be treated with a sufficient amount of hydrochloric acid to reduce the pH to less than about 1.0 to precipitate chloropentamminecobalt(III) dichloride and hexamminecobalt(III) trichloride. Filtration of the solution results in the precipitated cobalt ammine halides being separated from the acid solution containing soluble cation impurities.

The crude cobalt ammine halide precipitate may be further purified by subsequent crystallizations wherein the cobaltic ammine halide precipitate is first dissolved in ammonium hydroxide solution, next, acidified to produce a cobaltic ammine precipitate, and then is separated from the liquor containing impurities. The cobaltic ammine halide precipitate halide is redissolved to form a solution of increased purity.

According to the process for producing cobalt powder as described in U.S. Pat. No. 4,184,868, the cobaltic ammine halide solution is digested for about 2 to about 10 hours at a temperature of from about 80 to about 100° C. to form a cobalt oxide hydrate precipitate which is separated from the solution. The wet cobalt containing precipitate is reduced at an elevated temperature to form cobalt powder. The powder is separated into portions by screening. The portion remaining on the screening surface which is oversized is called tailings and is unsuited for use as fine cobalt powder. Any process which reduces the amount of tailings may be desirable for increasing the yield of cobalt powder. The process of the present invention is an improvement of the process as described in U.S. Pat. No. 4,184,368 since the portion of tailings may be reduced by a significant amount.

According to the process described in copending application Ser. No. 038,970 cobaltic hexammine chloride is produced as an intermediate step prior to treatment with an alkali metal hydroxide to produce a cobalt containing precipitate. According to a preferred process of the present invention it is desirable that the solution prior to heating comprise a major portion of the cobalt in the form of cobaltic hexammine halide. It is even more preferable that substantially all the cobalt present in solution be in the form of cobaltic hexammine halide.

The improvement of the present invention resides in digesting the aqueous solution of soluble cobaltic ammine halide by heating to a temperature of at least about 120 degrees centigrade to decompose the cobaltic ammine halide. While the temperature may exceed 200° C., there is no advantage in exceeding this temperature and unnecessary heating costs are introduced. At temperatures below 120° C. it is more difficult to decompose the cobaltic ammine halide to a cobalt containing precipitate that may be readily reduced to cobalt metal powder without tailings. The process of this invention is effected in a closed vessel to avoid vaporization and thereby permit the higher temperatures desired. The temperature is maintained until substantially all of the ammine halide has decomposed. Generally times on the order of from about one to about 6 hours are sufficient.

The cobalt containing precipitate formed preferably has a black coloration. It is believed to be an amorphous hydrated cobaltic compound. Although it is difficult to measure particle size of the wet precipitate, it appears that particles are from about 10 to about 25 microns in size. Air drying the cobalt containing precipitate at a temperature of about 100° C. results in the formation of particles having an average particle size from about 2 to about 5 microns. These later particles appear to be a hydrated cobaltic oxide having the formula $Co_2O_3.1H_2O$.

The wet cobalt containing precipitate is reduced to give a fine cobalt metal powder preferably having an average particle size of less than about 2 microns. Substantially all of the cobalt metal powder after reduction has a particle size less than about 2 microns. After separating the cobalt precipitate from the solution, it is heated in a reducing atmosphere for a time and temperature sufficient to reduce the precipitate to the cobalt metal powder. Such a reduction is typically carried out in a hydrogen atmosphere for a time of about 1 to 6 hours at a temperature from about 350° C. to 600° C.

The following examples will further illustrate the specific embodiments of this invention. It should be understood, however, that these examples are given by way of illustration in that limitation. All temperatures are in degrees centigrade and all parts are by weight, unless otherwise indicated.

EXAMPLE 1

One hundred milliliters of cobalt chloride solution obtained by the digestion of scrap tungsten carbide in hydrochloric acid is diluted with dionized water to a specific gravity of 1.252 and a pH of 0 at 22° C. resulting in a concentration of about 115 grams of cobalt chloride per liter. Ammonium hydroxide is then added to lower the specific gravity to about 1.038 and raise the pH to about 9.3 at 50° C. The solution is aerated for about 3 hours. The resulting oxidized solution is then heated to 90° C. and held for 15 minutes after which hydrochloric acid is added to lower the pH to 0.4 at 35° C. The solution is then digested at 90° C. for one hour with agitation. The resulting solution is then slowly cooled to below 70° C. after which it is wrapped and cooled with the aide of cooling water to 35° C. at which temperature the cooling water is removed, agitation is stopped and the precipitate is allowed to settle. A portion of the mother liquor is then decanted. The remaining mother liquor is then filtered to remove the precipitate. Forty-two grams of a crude cobalt pentammine chloride and hexammine chloride are formed. This crude ammine complex is then charged to 500 milliliters of dionized water at about 60° C. With agitation, 50 milliliters of ammonium hydroxide are added to achieve a pH of about 10 at 30° C. The slurry is then heated to about 65° C. until the pentammine and hexammine chloride have dissolved resulting in 550 milliliters of solution having a pH of 9.1. The solution is then filtered and the filtrate is placed in an autoclave capable of withstanding pressures up to 6000 lbs per square inch. After sealing the autoclave, the solution is stirred and heated to 150° C. resulting in a pressure of about 100 pounds per square inch. The heating is continued for about 6 hours. The resulting mixture is cooled in the autoclave. The precipitate formed is allowed to settle and remove by filtration. After washing, the resulting precipitate is reduced to a fine grained cobalt metal powder in a hydrogen atmosphere at a temperature of about 500° C.

EXAMPLE 2

The following are added successively to a 2000 milliliter beaker that is equipped with a 2.5 inch magnetic stirring bar: 250 milliliters of a 28 percent by weight aqueous ammonium hydroxide; 200 milliliters of aqueous cobaltous chloride solution in a 2.8 molar hydrochloric acid containing 120 grams of cobalt per liter and up to 10 percent of each impurity on a cobalt basis of iron, manganese, magnesium, aluminum, sodium, calcium, nickel, chromium, nickel, chromium, copper and 4.9 grams of granular activated charcoal. The resultant mixture having a pH value of 9.7 is maintained at a temperature of 40° C. and stirred for 7 hours. Successively, the resulting suspension is treated with 250 milliliters of a 36 percent by weight aqueous hydrochloric acid solution, cooled to 3° C. in an ice bath, and filtered on a funnel. A mixture of insoluble yellow hexamminecobalt (III) chloride and charcoal is obtained after a wash of 120 millimeters of 6 M hydrochloric acid is applied to the solids in the funnel. Next, the solids are added to 500 milliliters of hot water and the pH value of the resultant mixture is adjusted to 8.0 with sodium hydroxide. After heating the suspension to 90° C., it is filtered on a funnel to remove iron, aluminum and other precipitated cations. The filtrate containing 24 grams of cobalt per liter is successively treated with 550 milliliters of a 36 percent by weight hydrochloric acid solution, cooled to 5° C. in an ice bath and filtered on a funnel. Washing the resultant insoluble hexamminecobalt(III) chloride with 100 ml. of 6 M HCl results in a 98% yield of extremely pure product. Based on cobalt, the impurities present in parts per million are: Ca<4.0; Cu<3.0; Mg<2.0; Mn 5.4; Ni<10; S:<43; Cr<8.0 and Fe<13. To a one liter chamber in an autoclave equipped with a stirrer is added 750 milliliters of an aqueous solution containing hexamminecobalt(III) chloride in the amount based on 18 grams of cobalt per liter. The autoclave is sealed and the solution is stirred at 150° C. and at a pressure of about 100 pounds per square inch for six hours. The resultant mixture is cooled, filtered and washed to give a black solid. Reducing the black solids in a hydrogen atmosphere at a temperature of 500° C. gave 13.3 grams of soft, extra fine cobalt powder. Substantially all of the cobalt powder passed through a 100 mesh screen and was analyzed as having a FSSS value of 1.2.

While preferred embodiments of this invention have been described and illustrated, it is to be recognized that modifications and variations thereof may be made without departing from the spirit and scope of this invention as described in the appended claims.

INDUSTRIAL APPLICABILITY

The method described and claimed herein is particularly useful in the formation of extra fine particle size cobalt powders of high purity, which is useful, for example, as a starting material in the formation of cemented carbides, e.g., tungsten carbide.

What is claimed is:

1. A method for producing a fine metal powder comprising heating an aqueous solution of soluble cobaltic ammine halide to a temperature of at least 120 degrees centigrade for a sufficient period of time to decompose substantially all of said cobaltic ammine halide to form an amorphous hydrated cobalt oxide containing precipitate, said heating being carried out at a suitable pressure in a sufficiently closed vessel to permit said temperature being attained in said solution, said aqueous solution of soluble cobaltic ammine halide consist essentially from about 5 grams per liter cobaltic ammine chloride based on cobalt present in solution up to the limits of solubility of cobaltic ammine chloride, water, and less than 2 percent by weight impurities based on cobalt present in solution, separating the cobalt containing precipitate from the resulting solution, reducing said cobalt containing precipitate to form fine particles of cobalt.

2. A method according to claim 1 wherein said soluble cobaltic ammine halide is selected from the group consisting of cobaltic hexammine halide and cobaltic pentammine halide and mixtures thereof.

3. A method according to claim 2 wherein said cobaltic ammine halide comprises a major portion of cobaltic hexammine halide.

4. A method according to claim 2 wherein said cobaltic ammine halide comprises a substantially all cobaltic hexammine halide.

5. A method according to claim 4 wherein said aqueous solution consist essentially of less than about 0.2 percent by weight based on cobalt present in solution.

6. A method according to claim 5 wherein said cobalt containing precipitate comprises a black wet cobalt hydrate.

7. A method according to claim 6 wherein substantially all of said cobalt containing precipitate is reducible to cobalt particles having a particle size less than about 2 microns.

* * * * *